US007167146B2

(12) United States Patent
Kang

(10) Patent No.: US 7,167,146 B2
(45) Date of Patent: Jan. 23, 2007

(54) PLASMA DISPLAY PANEL DRIVING METHOD AND APPARATUS FOR REDUCING ADDRESS POWER CONSUMPTION

(75) Inventor: Seong Ho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 493 days.

(21) Appl. No.: 10/223,621

(22) Filed: Aug. 20, 2002

(65) Prior Publication Data

US 2003/0058194 A1 Mar. 27, 2003

(30) Foreign Application Priority Data

Aug. 21, 2001 (KR) ..... 2001-0050329

(51) Int. Cl.
*G09G 3/28* (2006.01)

(52) U.S. Cl. ..... 345/68

(58) Field of Classification Search ..... 345/37, 345/41, 42, 60–72, 204, 690, 692, 693
See application file for complete search history.

(56) References Cited

U.S. PATENT DOCUMENTS 6,100,863 A * 8/2000 Zhu ..... 345/89
6,211,867 B1 * 4/2001 Kim ..... 345/211
6,333,725 B1 * 12/2001 Kim ..... 345/61
6,483,250 B1 * 11/2002 Hashimoto et al. ..... 315/169.4
6,628,275 B1 * 9/2003 Vossen et al. ..... 345/211
6,646,625 B1 * 11/2003 Shigeta et al. ..... 345/63
2001/0011976 A1 * 8/2001 Kasahara et al. ..... 345/60
2002/0000955 A1 * 1/2002 Derksen et al. ..... 345/60
2002/0041275 A1 * 4/2002 Mccormack ..... 345/204

* cited by examiner

*Primary Examiner*—Richard Hjerpe
*Assistant Examiner*—Kevin M. Nguyen
(74) *Attorney, Agent, or Firm*—Fleshner & Kim, LLP

(57) ABSTRACT

A method of driving a plasma display panel and an apparatus thereof wherein a switching frequency of a data drive IC is reduced to decrease power consumption required for an addressing operation. In the method and apparatus, a plurality of write sub-fields at which a writing data for turning on a cell is subject to a binary coding and a plurality of erase sub-fields for expressing a gray scale value while turning off a desired cell with respect to the cells having been turned on the previous sub-fields including said write sub-fields are established. An erase data having a logic value for turning off the cells is mapped on erase sub-fields, the number of which is smaller than that of said erase sub-fields. A data having a second logic value different from a logical value of said erase data is mapped onto the remaining erase sub-fields other than the erase sub-field on which said erase data has been mapped.

36 Claims, 6 Drawing Sheets

PLASMA DISPLAY PANEL DRIVING METHOD AND APPARATUS FOR REDUCING ADDRESS POWER CONSUMPTION

BACKGROUND OF THE INVENTION

1. Field of the Invention

This invention relates to a driving technique for a plasma display panel, and more particularly to a method of driving a plasma display panel and an apparatus thereof that is capable of reducing power consumption required for an addressing.

2. Description of the Related Art

Generally, a plasma display panel (PDP) radiates a fluorescent body using an ultraviolet with a wavelength of 147 nm generated upon discharge of an inactive mixture gas, such as He+Xe, Ne+Xe or He+Ne+Xe, to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP has wall charges accumulated in the surface thereof upon discharge and protects electrodes from a sputtering generated by the discharge, it has advantages of a low-voltage driving and a long life.

In order to express gray levels of a picture, such a PDP is driven by dividing one frame into various sub-fields having a different light-emission frequency. Each sub-field is again divided into a reset period for causing a uniform discharge, an address period for selecting a discharge cell and a sustain period for implementing gray levels depending upon a discharge frequency. For instance, when it is intended to display a picture of 256 gray levels, a frame interval equal to 1/60 second (i.e. 16.67 ms) is divided into 8 sub-fields SF1 to SF8 as shown in FIG. 1. Each of the 8 sub-fields SF1 to SF8 is again divided into a reset period, an address period and a sustain period. Herein, the reset period and the address period of each sub-field are equal every sub-field, whereas the sustain interval and the discharge frequency are increased at a ratio of $2^n$ (wherein n=0, 1, 2, 3, 4, 5, 6 and 7) at each sub-field. As mentioned above, since a sustain period is differentiated at each sub-field, gray levels of a picture can be displayed.

The PDP may generate a pseudo contour noise from a moving picture because of a characteristic expressing gray levels of a picture by a combination of sub-fields. If a pseudo contour noise occurs, then a pseudo noise emerges on the field to deteriorate a display quality. For instance, if the field is moved into the left after the left half of the field was displayed at a gray scale value of 128 and the right half of the field was displayed at a gray scale value of 127, then a peak white, that is, a white stripe emerges at a boundary portion between the gray scale values 128 and 127. To the contrary, if the field is moved into the right after the left half of the field was expressed at a gray scale value of 128 and the right half of the field was expressed as a gray scale value of 127, then a black level, that is, a black stripe emerges at a boundary portion between the gray scale values 127 and 128.

In order to eliminate a pseudo contour noise of a moving picture, there has been suggested a scheme of dividing one sub-field to add one or two sub-fields, a scheme of re-arranging a sequence of the sub-fields, a scheme of adding sub-fields and re-arranging a sequence of sub-fields, or an error diffusion method, etc.

Such a PDP driving method is largely classified into a selective writing system and a selective erasing system depending on an emission of the discharge cell selected by the address discharge.

The selective writing system initializes the entire field in the reset period (or set-up period) and thereafter turns on the discharge cells selected by the address discharge. In the sustain period, a discharge of the discharge cells selected by the address discharge is sustained to display a picture.

In the selective writing system, a scanning pulse and a data pulse applied to the scan electrode Y and the address electrode X, respectively has a pulse width set to about 3 μs or more to cause a stable writing discharge within the selected discharge cell.

If the PDP has a resolution of VGA (video graphics array) class, it has total 480 scanning lines. Accordingly, in the selective writing system, an address period within one frame requires total 11.52 ms when one frame interval (i.e., 16.67 ms) includes 8 sub-fields. On the other hand, a sustain period is assigned to 3.05 ms in consideration of a vertical synchronizing signal Vsync. Herein, the address period is calculated by 3 μs(a pulse width of the scanning pulse/the data pulse)×480 lines×8(the number of sub-fields) per frame. The sustain period is a time value (i.e., 16.67 ms−11.52 ms−0.3 ms−1 ms−0.8 ms) obtained by subtracting an address interval of 11.52 ms, once reset interval of 0.3 ms, and an extra time of the vertical synchronizing signal Vsync of 1 ms and an erasure interval of 100 μs×8 sub-fields from one frame interval of 16.67 ms.

In the selective writing system, the sustain period becomes insufficient or fails to be assigned if the sub-fields are added so as to eliminate a pseudo contour noise of a moving picture. For instance, in the selective writing system, if two sub-fields of the 8 sub-fields are divided such that one frame includes 10 sub-fields, then the display period, that is, the sustain period becomes absolutely insufficient. If one frame includes 10 sub-fields, the address period becomes 14.4 ms, which is calculated by 3 μs(a pulse width of the scanning pulse)×480 lines×10(the number of sub-fields) per frame. On the other hand, the sustain period becomes −0.03 ms (i.e., 16.67 ms−14.4 ms−0.3 ms−1 ms−1 ms) which is a time value subtracting an address interval of 14.4 ms, once reset period of 0.3 ms, an erasure interval of 100 μs×10 sub-fields and an extra time of the vertical synchronizing signal Vsync of 1 ms from one frame interval of 16.67 ms.

Accordingly, in such a selective writing system, a sustain period of about 3 ms can be assured when one frame consists of 8 sub-fields, whereas it becomes impossible to assure a time for the sustain period when one frame consists of 10 sub-fields. In order to overcome this problem, there has been suggested a scheme of providing a divisional driving of one field by a double bank system. However, such a scheme raises another problem of a rise of manufacturing cost because it requires an addition of about twice data driving IC's.

A contrast characteristic of the selective writing system is as follows. In the selective writing system, when one frame consists of 8 sub-fields, a light of about 300 cd/$m^2$ corresponding to a brightness of the peak white is produced if a field continues to be turned on in the entire sustain period of 3.05 ms. On the other hand, if the field is sustained in such a state as turned on only in once reset period and turned off in the remaining period within one frame, a light of about 0.7 cd/$m^2$ corresponding to the black is produced. Accordingly, a darkroom contrast ratio in the selective writing system has a level of 430: 1.

The selective erasing system makes a writing discharge of the entire field in the reset period and thereafter turns off the discharge cells selected in the address period by an erasing discharge. Then, in the sustain period, only the discharge cells having not selected by the address discharge are subject to a sustain discharge, thereby displaying a picture.

In the selective erasing system, an erasing data pulse with a pulse width of about 1 μs is applied to the address electrode X so that an erasure discharge can occur within the discharge cells selected during the address discharge. At the same time, a scanning pulse with a pulse width of 1 μs synchronized with the selective erasing data pulse is applied to the scanning electrode Y.

If the PDP having a resolution of VGA (video graphics array) class is driven by a selective erasing system in which one frame interval (i.e., 16.67 ms) is divided into 8 sub-fields, then an address period required within one frame is merely total 3.84 ms. Accordingly, a sustain period can be sufficiently assigned to about 10.73 ms in consideration of a vertical synchronizing signal Vsync. Herein, the address period is calculated by 1 μs(a pulse width of the scanning pulse)×480 lines×8(the number of sub-fields) per frame. The sustain period is a time value (i.e., 16.67 ms−3.84 ms−0.3 ms−1 ms−0.8 ms) obtained by subtracting an address period of 3.84 ms, once reset period of 0.3 ms, and an extra time of the vertical synchronizing signal Vsync of 1 ms and an entire writing time of 100 μs×8(the number of sub-fields) from one frame interval of 16.67 ms. In such a selective erasing system, since the address period is small, the sustain period can be assured even though the number of sub-fields is enlarged. If the number of sub-fields SF1 to SF10 within one frame is enlarged into ten as shown in FIG. 2, then the address period becomes 4.8 ms which is calculated by 1 μs(a pulse width of the scanning/data pulse)×480 lines×10(the number of sub-fields) per frame. On the other hand, the sustain period becomes 9.57 ms which is a time value (i.e., 16.67 ms−4.8 ms−0.3 ms−1 ms−1 ms) obtained by subtracting an address period of 4.8 ms, once reset period of 0.3 ms, an extra time of the vertical synchronizing signal Vsync of 1 ms and the entire writing time of 100 μs×10(the number of sub-fields) from one frame interval of 16.67 ms. Accordingly, the selective erasing system can assure a sustain period at least three times longer than the above-mentioned selective writing system having 8 sub-fields even though the number of sub-fields is enlarged into ten, so that it can realize a bright field with 256 gray levels.

However, the selective erasing system has a disadvantage of low contrast because the entire field is turned on in the entire writing interval as a non-display period. For instance, if the entire field continues to be turned on in the sustain period of 9.57 ms within one frame consisting of 10 sub-fields SF1 to SF10 as shown in FIG. 3, then a light of about 300 cd/M$^2$ corresponding to a brightness of the peak white is produced. A brightness corresponding to the black is 15.7 cd/M$^2$, which is a brightness value of 0.7 cd/M$^2$ generated in once reset period plus a brightness value of 1.5 cd/M$^2$×10 (the number of sub-fields) generated in the entire writing interval within one frame. Accordingly, since a darkroom contrast ratio in the selective erasing system is equal to a level of 950:15.7 =60:1 when one frame consists of 10 sub-fields SF1 to SF10, the selective erasing system has a low contrast. As a result, a driving method using the selective erasing system provides a bright field owing to an assurance of sufficient sustain period, but fails to provide a clear field and hence causes a feeling of blurred picture due to a poor contrast.

In order to overcome disadvantages such as a lack of driving time and a deterioration of contrast, etc. occurring in the selective writing system or in the selective erasing system, Korea Patent Application No. 2000-12669, filed by the applicant of this application on Mar. 3, 2000, has suggested a scheme of mapping a data such that the selective write sub-fields co-exists in the selective erasing sub-fields. Such a driving scheme, hereinafter referred to as "SWSE", provides a data mapping by running parallel with a binary coding and a linear coding like the following Table 1, assuming that one frame should consist of 12 sub-fields corresponding to brightness weighting values of 1, 2, 4, 8, 16, 32, 32, 32, 32, 32, 32 and 32.

TABLE 1

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0~31 | Binary Coding | | | | | x | x | x | x | x | x | X |
| 32~63 | Binary Coding | | | | | 0 | x | X | X | X | x | X |
| 64~95 | Binary Coding | | | | | 0 | 0 | X | X | X | X | X |
| 96~127 | Binary Coding | | | | | 0 | 0 | 0 | X | X | X | X |
| 128~159 | Binary Coding | | | | | 0 | 0 | 0 | 0 | X | X | X |
| 160~191 | Binary Coding | | | | | 0 | 0 | 0 | 0 | 0 | X | X |
| 192~223 | Binary Coding | | | | | 0 | 0 | 0 | 0 | 0 | 0 | X |
| 224~255 | Binary Coding | | | | | 0 | 0 | 0 | 0 | 0 | 0 | 0 |

As can be seen from Table 1, the first to fifth sub-fields SF1 to SF5 arranged at the front of the frame, of the first to twelfth sub-fields SF1 to SF12, is subject to a binary coding while the sixth to twelfth sub-fields (SF6 to SF12) is subject to a linear coding. Each of the seventh to twelfth sub-fields SF7 to SF12 is going to turn off the cells unnecessary for the previous sub-fields.

If a PDP having a resolution of VGA class is driven by a SWSE system as described in Table 1, then an address period and a sustain period within one frame interval are 11.52 ms and 3.35 ms, respectively. Herein, the address period requires 11.52 ms, which is summed 8.64 ms calculated by 3 μs(a pulse width of a selective writing scanning pulse)×480 lines×6 (the number of selective write sub-fields) per frame with 2.88 ms calculated by 1 μs(a pulse width of a selective erasing scanning pulse)×480 lines×6(the number of selective write sub-fields) per frame. The sustain period is 3.35 ms, which is a time value (i.e., 16.67 ms−11.52 ms−0.3 ms−1 ms−0.5 s) obtained by subtracting an address period of 11.52 ms, once reset period of 0.3 ms, an extra time of the vertical synchronizing signal Vsync of 1 ms and an erasing interval of 100 μs×5(the number of sub-fields)=0.5 ms from one frame interval of 16.67 ms. Accordingly, the SWSE system can not only enlarge the number of sub-fields in comparison to the selective writing system to reduce a pseudo contour noise from a moving picture, but also can more enlarge the sustain period from 3.05 ms into 3.35 ms in comparison to the selective writing system.

If a PDP having a resolution of VGA class is driven by a SWSE system as described in Table 1, then a light of about 330 cd/m$^2$ corresponding to a brightness of 'peak white' is produced when the entire field is turned on in the display period of 3.35 ms. If the field is turned on only in once reset period within one frame by a reset charge, then a light of 0.7 cd/m$^2$ corresponding to 'black' is produced. Accordingly, since a darkroom contrast ratio in the SWSE system is equal to a level of 470:1, a contrast in the SWSE system is more improved than a contrast (i.e., 60: 1) in the selective erasing system that includes 10 sub-fields within one frame and, at the same time, is more increased than a contrast (i.e., 430:1) in the selective writing system that includes 8 sub-fields within one frame.

Meanwhile, the PDP has large power consumption because it has a large size and bulk and is supplied with a high voltage for causing a discharge. A drive integrated circuit (IC) for driving the address electrode X and the scan electrode Y of the PDP causes large power consumption because it must apply a high voltage for causing a discharge to each electrode Y, Z and X. Moreover, power consumption of the drive IC may be increased due to a low efficiency of the PDP.

Most power consumption of the PDP occurs in the sustain period. The address period causes large power consumption next to the sustain period. A power of hundreds of watts is wasted in the sustain period while a power of ens of watts is wasted in the address period. Power consumption in the sustain period is mainly increased or decreased depending on a capacitance value C of of the PDP involves a capacitor C1 between the address electrodes X, a capacitor C2 between the address electrode X and the scan electrode Y, a capacitor C3 between the scan electrode Y and the common sustain electrode Z, and a capacitor C4 between the address electrode X and the common sustain electrode Z. More than 90% of power consumption in the address period is caused by a displacement current generated upon charge/discharge of the PDP. In power consumption in the address period, a magnitude of power onsumption caused by a displacement current can be expressed by the following equation:

$$P=IV=CV^{2f} \quad (1)$$

wherein C represents a capacitance value between the address electrode X and other electrodes Y and Z being adjacent thereto; V does a voltage of a data pulse; and f does an average switching frequency per unit time of the data drive IC.

As can be seen from the above equation (1), a scheme of reducing power consumption in the address period includes a method of lowering a data voltage V, a method of lowering a capacitance C of the PDP and a method of reducing a switching frequency f of the data drive IC. However, said method of lowering a data voltage V has a limit in reducing such a voltage because the data voltage V is a voltage for allowing the discharge cell to cause a discharge, and has a limit in reducing a capacitance of the PDP because the PDP intends to a high resolution and a large screen. Besides these methods, there is a method of adding an energy recovery circuit for recovering a reactive power from the PDP and then applying the recovered voltage to the PDP using a resonance circuit before an application of a data sustaining voltage. A detailed description as to the energy recovery circuit will be made later.

A condition that the capacitance value C of the PDP is large is when the discharge cells of adjacent sub-pixels have a different logical value as shown in FIG. 5. For instance, such a condition is satisfied at the event of a data pattern in which any one of the discharge cells of adjacent sub-pixels is turned on while other one thereof is turned off. Also, the capacitance value C is large when any one of the discharge cells of adjacent sub-pixels has a low gray scale value while other one thereof has a high gray scale value. A condition that the capacitance value C of the PDP is maximum is a data pattern in which the minimum gray level and the maximum gray level is adjacent to each other in a data pattern in which logical values between the discharge cells of adjacent sub-pixels are different from each other. The data pattern in which the capacitance value C of the PDP becomes maximum is referred to as "sub-pixel switching pattern".

Since different data voltages, i.e., data voltages of 0V and 70V are applied to adjacent address electrodes X as shown in FIG. 4 in the sub-pixel switching pattern, the capacitance C between the address electrodes X is charged to an extent of a difference of data voltages to have a large leakage current.

A switching frequency f of the data drive IC becomes maximum in the above-mentioned sub-pixel switching pattern. This is caused by a fact that a switching device of the data drive IC repeats its turn-on and turn-off every horizontal period because logical values of vertically adjacent sub-pixels become different. In other words, since a maximum switching frequency f of the data drive IC per one address electrode X in one frame interval is equal to the number of scan lines (i.e., scan electrodes or common sustain electrodes) x the number of sub-fields, a switching device of the data drive IC must repeats its turn-on/off every scanning operation in the sub-pixel switching pattern. For instance, if a resolution is a VGA class and one frame includes 8 sub-fields, then a switching frequency f of the data drive IC is 480(scan line)×8=3840. On the other hand, if one frame includes 12 sub-fields, then a switching frequency f of the data drive IC 480×12=5760.

Also, an average switching frequency of a data pattern that may be generally generated from a moving picture/still picture is large. For instance, in the SWSE driving system, an average switching frequency per electrode line generated at one frame is 3×480 lines +{(0+0+1+2+3+4+5+6)/8}×480 lines=2700. Herein, '3×480' represents a switching frequency per line of the selective write sub-fields SF1 to SF6 obtained by dividing total switching frequency occurring between a gray level range '0~31' and other gray level range by the number of gray level ranges. Further, '{ }' represents a switching frequency per one line of the selective erase sub-fields SF6 to SF12 obtained by dividing total switching frequency occurring between a gray level range '0~31' and other gray level range by the number of gray level ranges.

FIG. 6 shows a unit driver circuit of a data drive IC adopting an energy recovery circuit.

Referring to FIG. 6, the unit driver of the data drive IC includes an energy recovery circuit 31 for applying a voltage to the address electrode line X using a voltage recovered from the PDP, and a data driver 32 for switching a voltage applied from the energy recovery circuit depending upon whether or not a data exists.

The energy recovery circuit 31 includes an external capacitor Cs for charging a voltage recovered from the PDP, first and third switches S1 and S3 connected, in parallel, to the external capacitor Cs, an inductor L connected between a node between the first and third switches S1 and S3 and the data driver 32, a second switch S2 connected between an external sustain voltage source Vs and the inductor L, and a fourth switch S4 connected between a ground voltage source GND and the inductor L.

The first switch S1 is turned on before an application of a data, to thereby form a current path between the external capacitor Cs and the address electrode line X of the PDP. The second switch S2 is turned on at a time when the address electrode line X is charged until a sustain voltage level to apply a sustain voltage Vs to the address electrode line X of the PDP. The third switch S3 is turned on just after the PDP generated an address discharge, to thereby form a discharge path between the address electrode line X and the external capacitor Cs. In a time interval when the third switch S3 is turned on, the external capacitor Cs charges a voltage recovered from the PDP. The fourth switch S4 is turned on after a charge of the external capacitor Cs was terminated, to thereby maintain a voltage on the address electrode line X of the PDP at a ground potential GND.

The inductor L and a capacitance Cp of the PDP configures a LC serial resonance circuit, thereby allowing a resonance voltage to be charged into the address electrode line X of the PDP in a time interval when the first switch Si is turned on.

The data driver 32 includes a fifth switch S5 connected to the output terminal of the energy recovery circuit 31, and a sixth switch S6 connected between the fifth switch S5 and the ground voltage source GND. The address electrode line X is connected to an output terminal between the fifth switch S5 and the sixth switch S6.

The fifth switch S5 is turned on in a time interval when a data is inputted under control of a controller, thereby apply a voltage from the energy recovery circuit 31 to the address electrode line of the PDP. Further, the fifth switch S5 is turned off in a time interval when a data does not exist, to thereby cut off a current path between the energy recovery circuit 31 and the PDP.

The sixth switch S6 is turned on in a time interval when a data does not exist under control of the controller, thereby allowing a voltage on the address electrode line X to be kept at a ground voltage, whereas it is turned off in a time interval when a data is inputted.

If the energy recovery circuit is applied to the data drive IC as mentioned above, then power consumption of the data drive IC can be expressed by the following equation:

$$P=IV=CV^2f(1-\alpha) \quad (2)$$

wherein $\alpha$ represents an energy recovery efficiency according to the energy recovery circuit. In the data drive IC, a maximum energy recovery efficiency $\alpha$ is about 0.5.

As described above, in order to reduce a power wasted in the address period, a method of reducing a data voltage or a capacitance of the PDP and an energy recovery circuit may be employed. However, there exists a limit in reducing a data voltage or a capacitance of the PDP, and a limit in reducing power consumption using the energy recovery circuit because an energy recovery efficiency in the addressing operation is low. Therefore, a method of reducing a switching frequency is most effective to reduce a power wasted in the address period.

SUMMARY OF THE INVENTION

Accordingly, it is an object of the present invention to provide a method of driving a plasma display panel and an apparatus thereof wherein a switching frequency of a data drive IC is reduced to decrease power consumption required for an addressing operation.

In order to achieve these and other objects of the invention, a method of driving a plasma display panel according to one aspect of the present invention includes the steps of establishing at least one of write sub-field at which a writing data for selecting on-cells; establishing at least one of erase sub-field for expressing a gray scale value while selecting a off-cell among said on-cells selected in the previous sub-fields including said write sub-fields; mapping a erase data having a first logic value for selecting off-cell onto the number of erase sub-field smaller than the total number of erase sub-field; and mapping a data having a second logic value different from that of said erase data onto the remaining erase sub-field other than the erase sub-field on which said erase data has been mapped.

In the method, said erase data is mapped on a single of erase sub-field for determining a gray scale value. Otherwise, said erase data is mapped on a single of erase sub-field for determining a gray scale value and a predetermined number of sub-fields following the erase sub-field.

Herein, said erase data is linearly mapped on said erase sub-fields.

The data having the second logic value is the writing data.

A method of driving a plasma display panel according to another aspect of the present invention includes the steps of establishing at least one of erase sub-fields addressing off-cells; mapping a first data for selecting said off-cells onto the number of erase sub-field smaller than the total number of erase sub-field; and mapping a second data having a logic value different from that of said first data onto the remaining erase sub-field other than the erase sub-field on which said first data has been mapped.

In the method, said first data is mapped on a single of erase sub-field for determining a gray scale value.

Otherwise, said first data is mapped on a single of erase sub-field for determining a gray scale value and a predetermined number of sub-fields following the erase sub-field.

Herein, said erase data is linearly mapped on said erase sub-fields.

The second data has a logical value for selecting an on-cell.

A driving apparatus for a plasma display panel according to still another aspcet of the present invention includes a plurality of address electrodes supplied with an erase data for selecting a off-cell and a writing data for selecting on-cell; a sub-field mapping unit for mapping said erase data onto the number of at least erase sub-fields smaller than the total number of erase sub-field selecting said off-cell in response to said erase data and for mapping a data having a logic value different from that of said erase data onto the remaining erase sub-field other than the erase sub-field on which said erase data has been mapped; and a data driver for applying a video data to the address electrodes in response to said erase data, said writing data and data having a logic value different from that of said erase data.

In the driving apparatus, said sub-field mapping unit maps said erase data onto a single of erase sub-field for determining a gray scale value.

Otherwise, said sub-field mapping unit maps said erase data onto a single of erase sub-field for determining a gray scale value and a predetermined number of sub-fields following the erase sub-field.

Herein, said sub-field mapping unit linearly maps said erase data onto said erase sub-fields.

The sub-field mapping unit maps said writing data onto at least one of write sub-field for selecting on-cells using a binary coding.

The data having a logic value different from that of said erase data is said writing data.

The driving apparatus further includes plurality of scan electrodes crossed with said address electrodes; a scan driver supplying a scan pulse to said scan electrodes and supplying a sustain pulse for sustaining a discharge of on-cell; a plurality of sustain electrodes crossing with said address electrodes and pairing with said scan electrodes; a sustain driver for supplying said sustain pulse, which operates alternatively with said scan driver.

In the driving apparatus, said sub-field mapping unit maps said writing data on at least one of write sub-field so that said on-cell is selected.

Otherwise, said sub-field mapping unit maps said writing data on said write sub-field using a binary coding.

said sub-field mapping unit maps said erase data while selecting said off-cell among said on-cells selected in the previous sub-fields including said write sub-fields.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
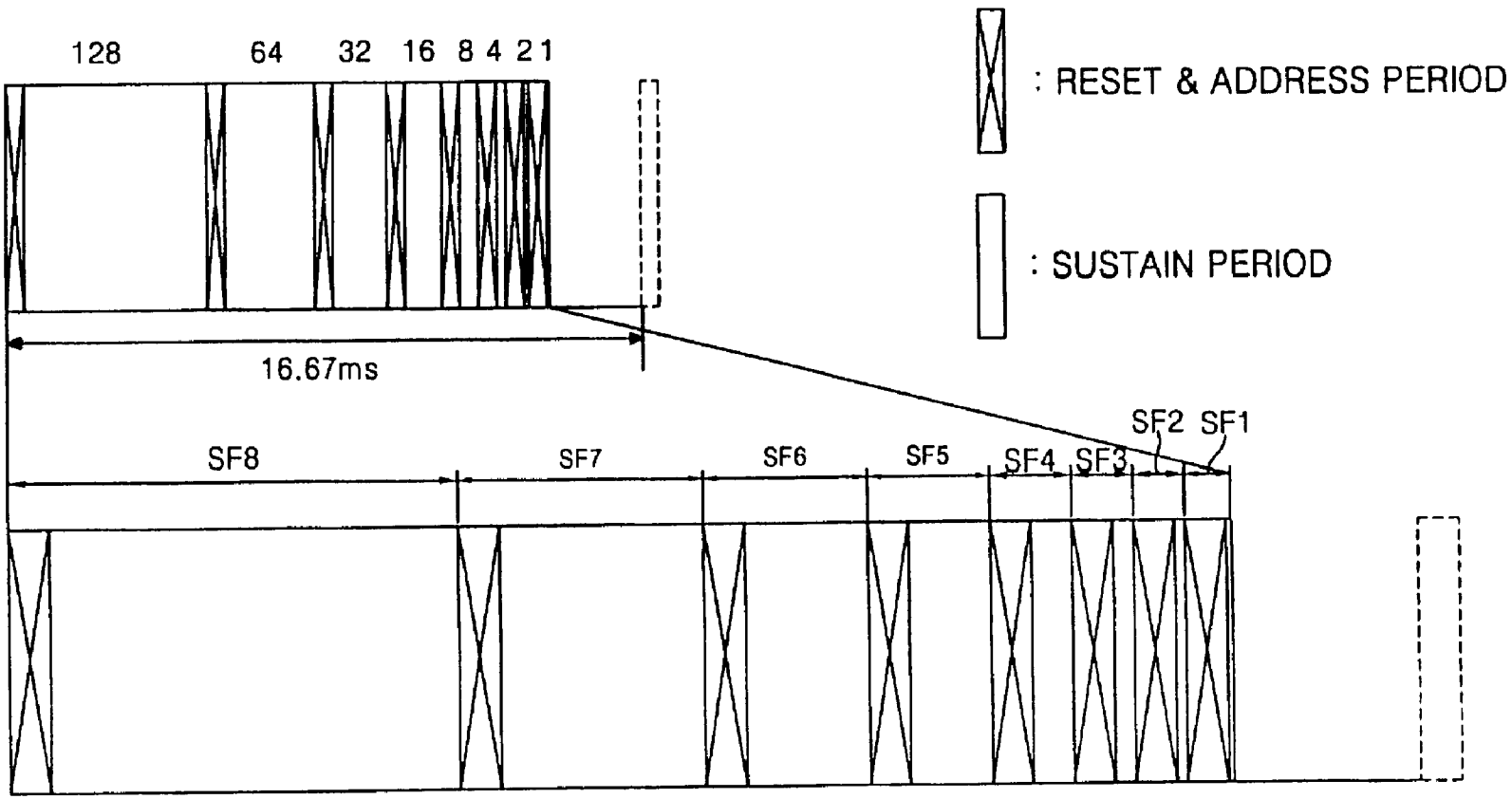
FIG.1 CONVENTIONAL ART
FIG. 1 depicts one frame including 8 sub-fields in a conventional method of driving a plasma display panel.
Figure 2:
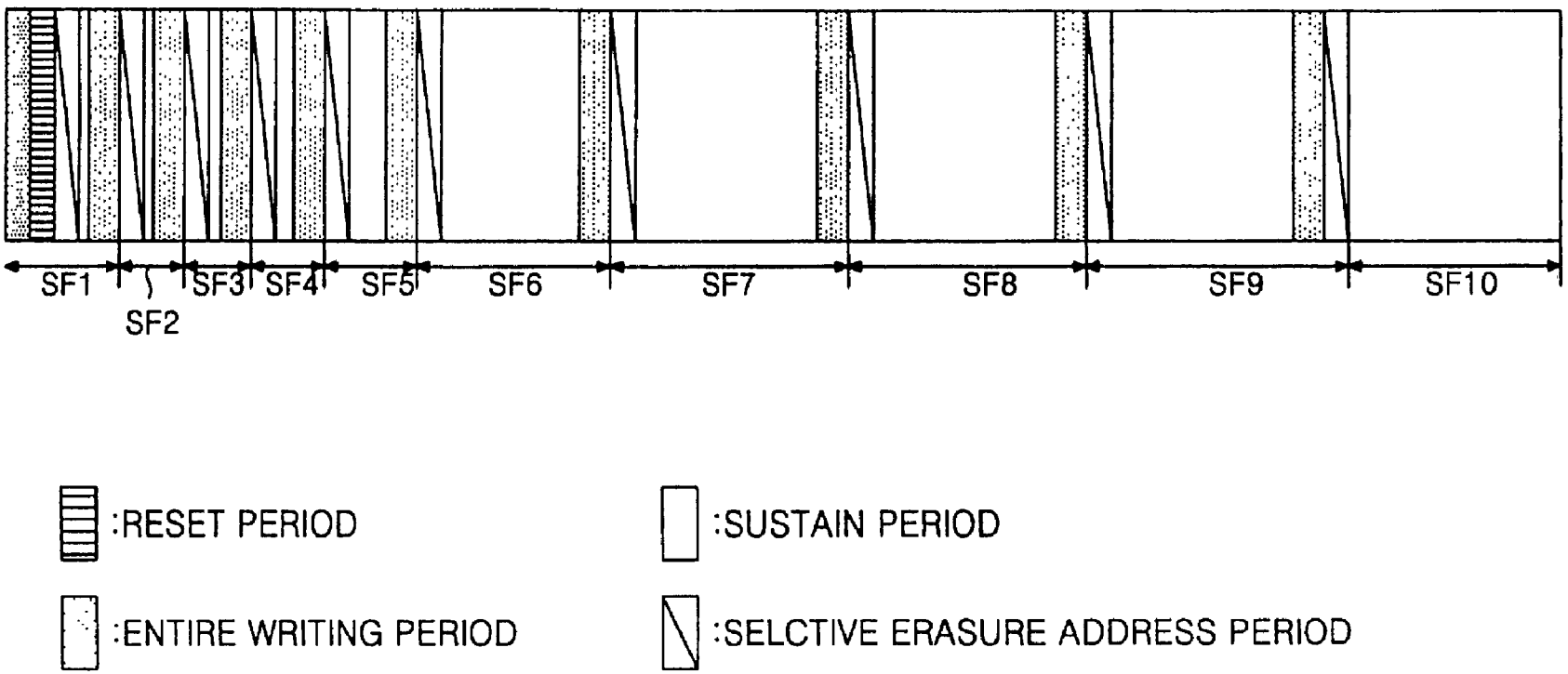
FIG.2 CONVENTIONAL ART
FIG. 2 depicts one frame configuration in which 10 sub-fields are included and an entire writing discharge is preceded every sub-field in a conventional method of driving a plasma display panel.
Figure 3:
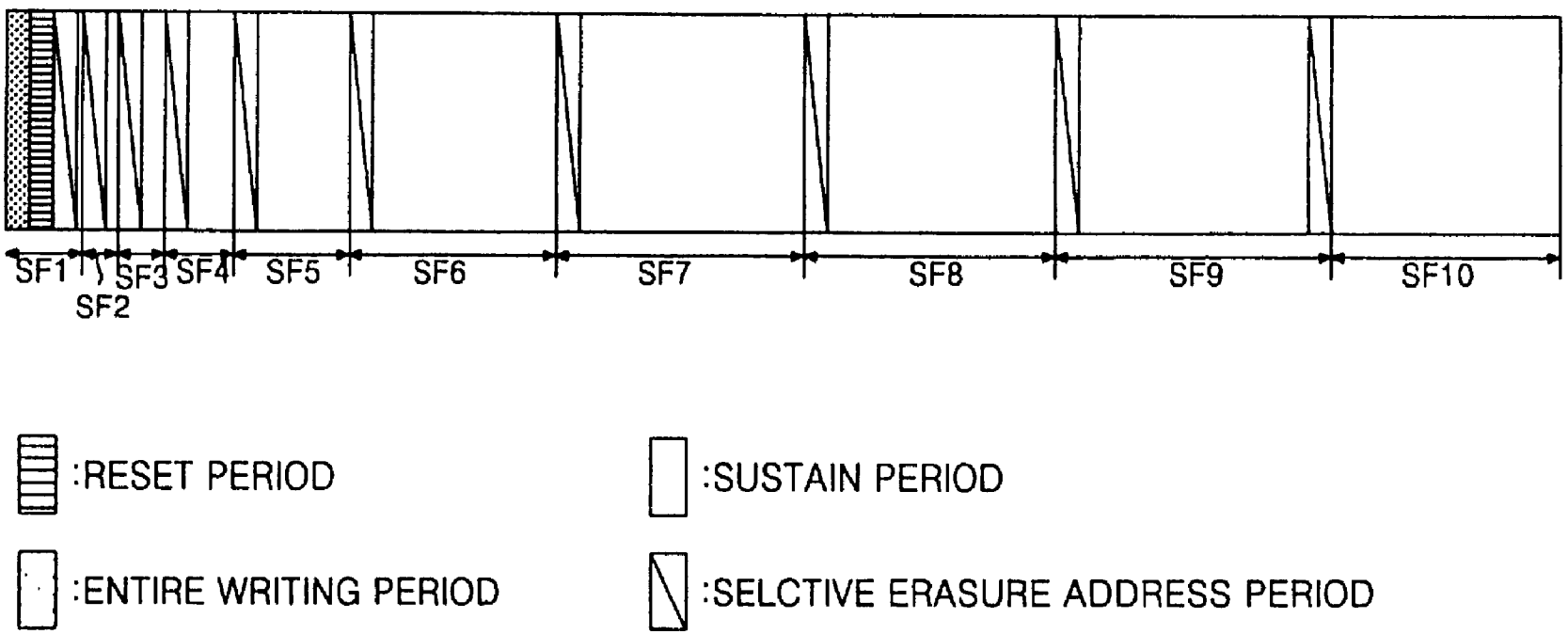
FIG.3 CONVENTIONAL ART
FIG. 3 depicts one frame configuration in which 10 sub-fields are included and an entire writing discharge is included once in a conventional method of driving a plasma display panel.
Figure 4:
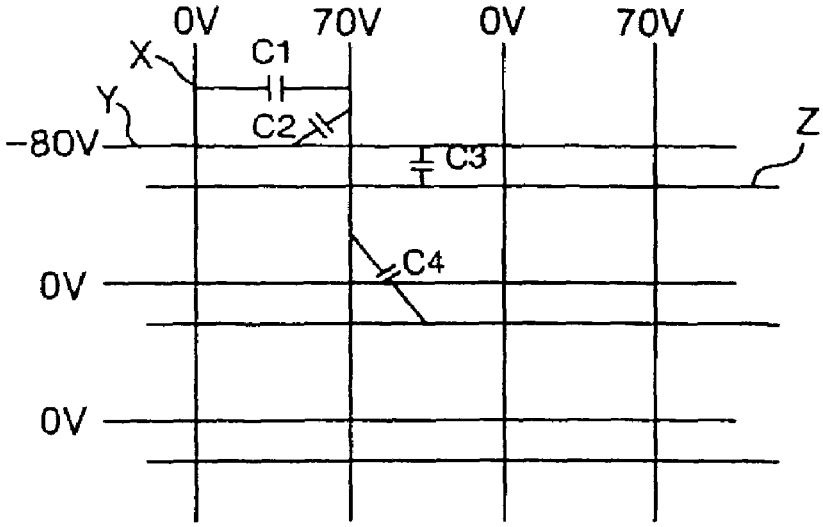
FIG. 4 CONVENTIONAL ART
FIG. 4 is an equivalent circuit diagram of a capacitance of the PDP.
Figure 5:
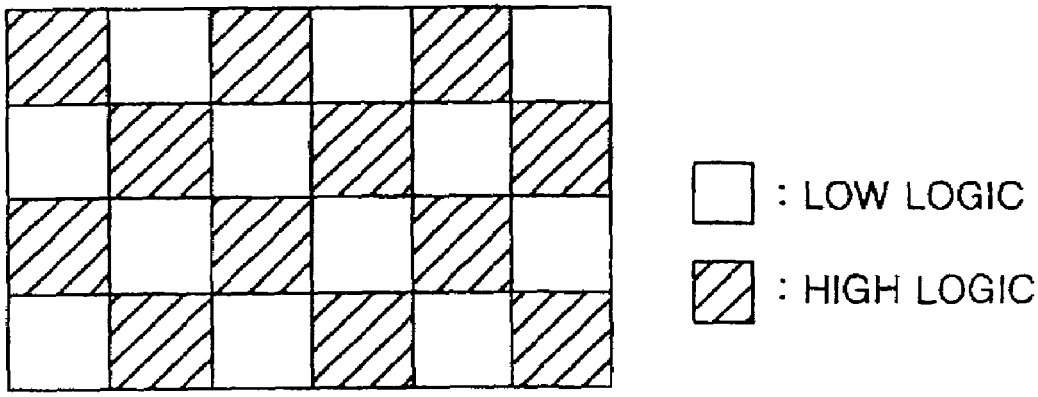
FIG. 5 CONVENTIONAL ART
FIG. 5 schematically illustrates a sub-pixel switching pattern.
Figure 6:
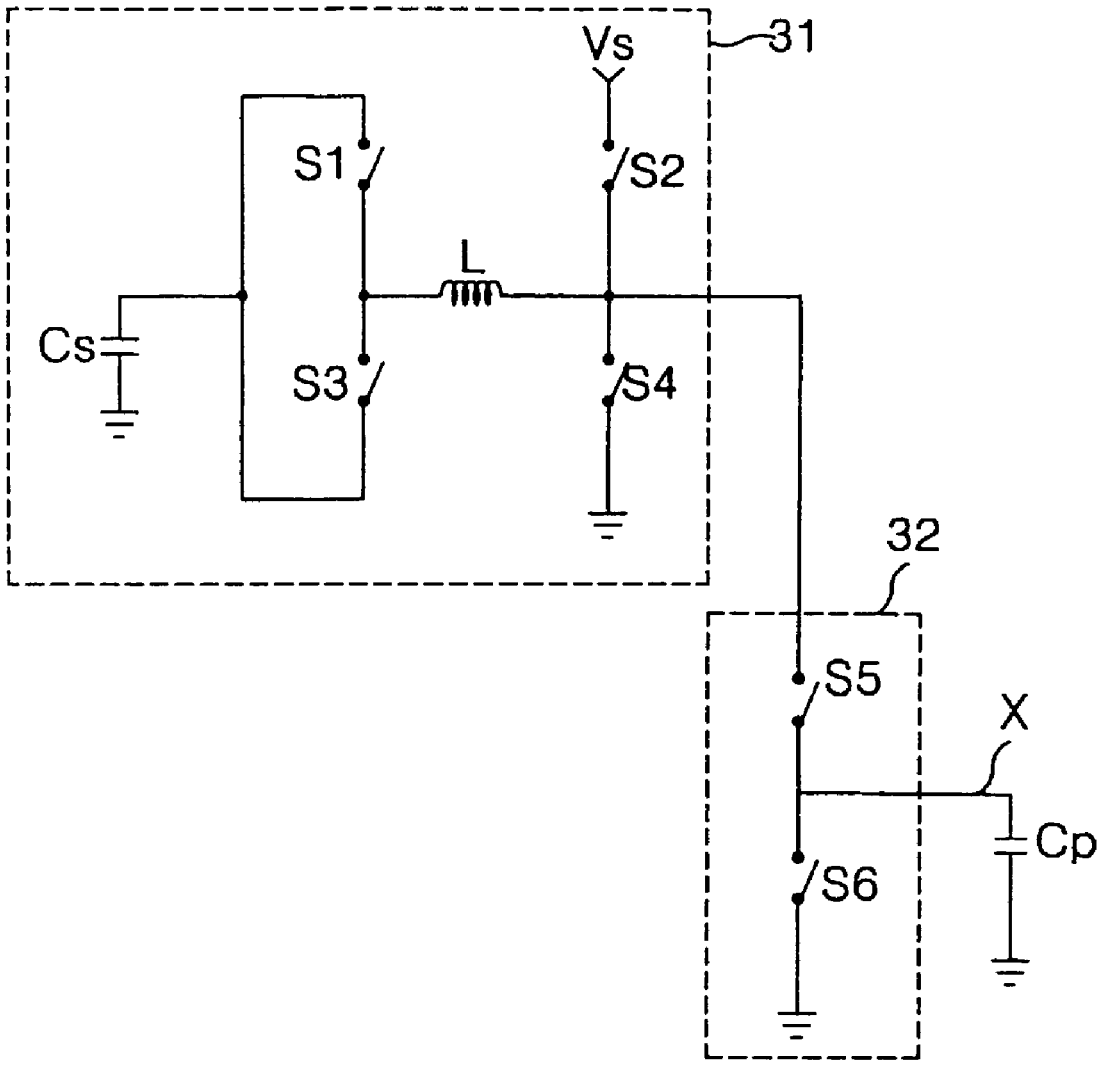
FIG.6 CONVENTIONAL ART
FIG. 6 is a circuit diagram of a unit driver of the data drive IC employing an energy recovery circuit.
Figure 7:
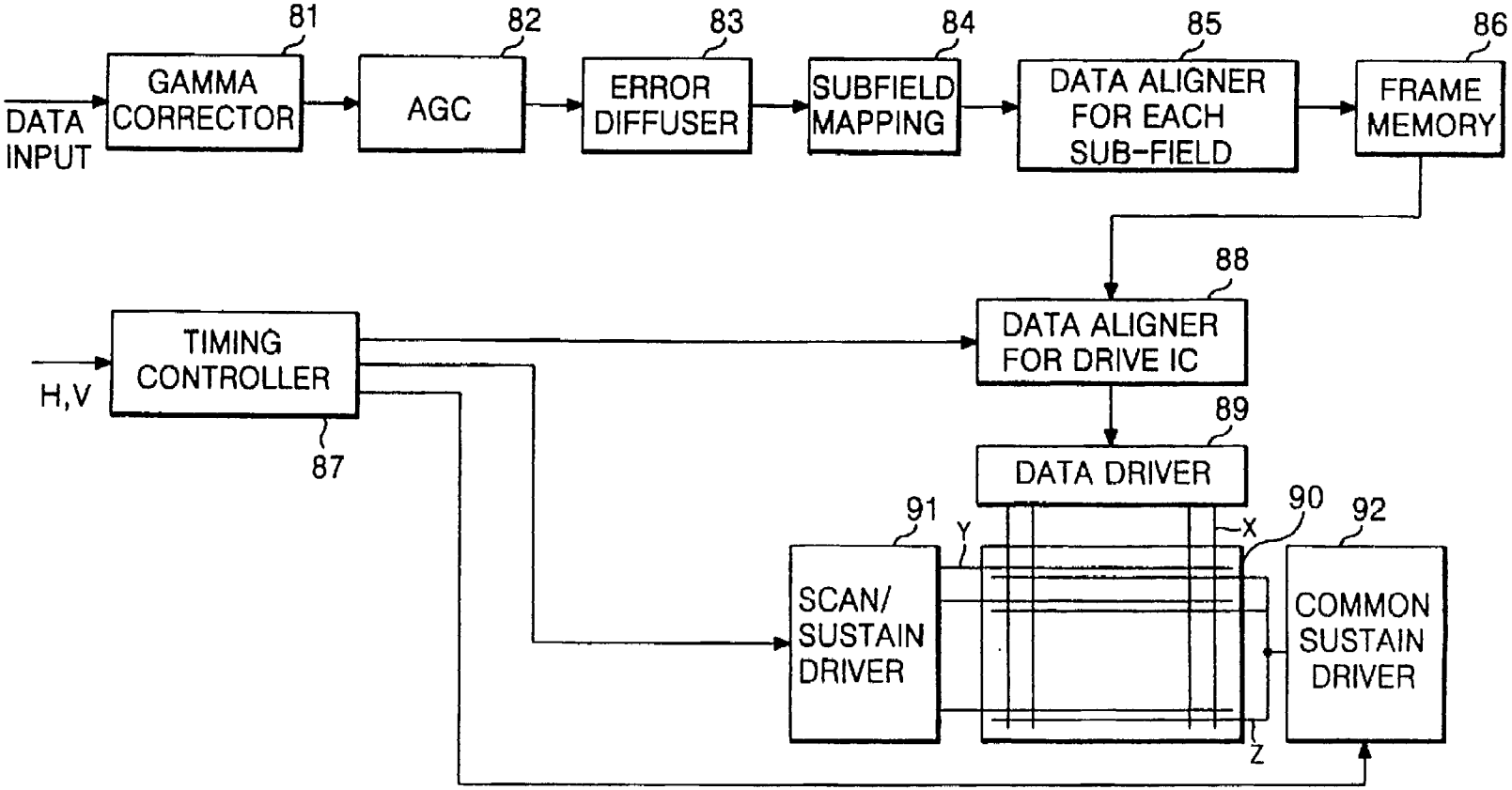
FIG. 7 is a block diagram of a driving apparatus for a plasma display panel according to an embodiment of the present invention.

Referring to FIG. 7, a driving apparatus for a plasma display panel (PDP) according to an embodiment of the present invention includes a data driver 89 for driving an address electrode X of a PDP 90, a scan/sustain driver 91 for driving a scan electrode Y of the PDP 90, a common sustain driver 92 for driving a common sustain electrode Z of the PDP 90, a timing controller 87 for controlling a driving timing of the PDP 90, and an automatic gain controller 82, an error diffuser 83, a sub-field mapping unit 84, a data aligner 85 for each sub-field, a frame memory 86 and a data aligner 88 for each drive IC. The data driver 89 includes a plurality of data drive IC's each connected to a desired number of address electrodes X to thereby supply a data supplied from the data aligner 88 for each drive IC to n address electrodes X (wherein n is an integer) every horizontal period. The data driver 89 includes an energy recovery circuit 31 and a data driver 32 as shown in FIG. 6, and applies a data mapped like Table 2 to Table 4 as mentioned later to the address electrodes X.

The scan/sustain driver 91 is connected to m scan electrodes Y (wherein m is a certain integer which meets a relationship of m n) to simultaneously apply a reset pulse (or setup pulse) to m scan electrodes Y. Further, the scan/sustain driver 91 sequentially applies a scanning pulse to m scan electrodes Y in the address period and thereafter simultaneously applies a sustain pulse to m scan electrodes Y in the sustain period.

The common sustain driver 92 is commonly connected to m sustain electrodes Z (wherein m is a certain integer which meets a relationship of m n) to simultaneously apply a sustain pulse to m common sustain electrodes Z.

The timing controller 87 receives vertical/horizontal synchronizing signals H and V to generate a timing control signal, and applies the timing control signal to the data aligner 88 for each driver IC, the scan/sustain driver 91 and the common sustain driver 92 to control a driving timing.

The gamma corrector 81 makes a gamma correction of an image signal from the frame memory to linearly convert a brightness value according a gray scale value of the image signal. The automatic gain controller 82 plays a role to convert a gray level range of an input data RGB into a predetermined gray level range to uniformly compensate for a gain of the input data.

The error diffuser 83 is responsible for diffusing an error component into adjacent cells to finely adjusting a brightness value. To this end, the error diffuser 83 divides a data into a fixed number part and a decimal fraction part and multiply the decimal fraction part by a Floy-Steinberg coefficient, thereby diffusing an error into adjacent cells.

The sub-field mapping unit 84 expresses a gray scale while tuning off the turned-on cells at the previous sub-field as seen from the later Tables 3 to 6. Also, the sub-field mapping unit 84 maps a low logic of erase data (x) for turning off the selected cell(off-cell) on one sub-field for determining a gray scale value or this sub-field and the following sub-field. A detailed explanation as to this will be made later.

The data aligner 85 for each sub-field separates a data pattern mapped by the sub-field mapping unit 84 bit by bit, and aligns the least significant bit LSB on a sub-field at which a minimum brightness weighting value is set while aligning the most significant bit MSB on a sub-field at which a maximum brightness weighting value is set, thereby aligning each bit for each sub-field.

The frame memory 86 stores a data from the data aligner 85 for each sub-field at one frame unit. The data aligner 88 for each drive IC re-aligns a data from the frame memory 86 in correspondence with a data drive IC of the data driver 89 and applies the re-aligned data to the data driver 89.

A code table in which a data is mapped by the sub-field mapping unit 84 is as the following Table:

TABLE 2

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0~31 | Binary Coding | | | | | X | 0 | 0 | 0 | 0 | 0 | 0 |
| 32~63 | Binary Coding | | | | | 0 | X | 0 | 0 | 0 | 0 | 0 |
| 64~95 | Binary Coding | | | | | 0 | 0 | X | 0 | 0 | 0 | 0 |
| 96~127 | Binary Coding | | | | | 0 | 0 | 0 | X | 0 | 0 | 0 |
| 128~159 | Binary Coding | | | | | 0 | 0 | 0 | 0 | X | 0 | 0 |
| 160~191 | Binary Coding | | | | | 0 | 0 | 0 | 0 | 0 | X | 0 |
| 192~223 | Binary Coding | | | | | 0 | 0 | 0 | 0 | 0 | 0 | X |
| 224~255 | Binary Coding | | | | | 0 | 0 | 0 | 0 | 0 | 0 | 0 |

Referring to Table 2, a PDP driving method according to the first embodiment of the present invention is applicable to the SWSE driving system, and maps a low logic of data determining a gray scale value at the selective erase sub-fields on only one sub-field.

As can be seen from the above Table 2, in the PDP driving method according to the first embodiment of the present invention, one frame includes 12 sub-fields SF1 to SF12, and the first to sixth sub-fields SF1 to SF6 arranged at the front side of the frame are selective write sub-fields for addressing the turned-on cells(on-cell). The first to fifth sub-fields SF1 to SF5 thereof are subject to a binary coding.

In the address period of the selective write sub-fields SF1 to SF6, a writing data pulse having a pulse width of approximately 3 μs from the data drive IC is applied to the address electrode X and thus allows desired cells to cause a writing discharge, thereby producing wall charges and space charges within the cells. The cells, at which a writing discharge has been generated, causes a sustain discharge every sustain pulse in the sustain period.

The seventh to twelfth sub-fields SF7 to SF12 are selective erase sub-fields for addressing the turned-off cells. The sixth sub-field SF6, which is the last sub-field of the selective erase sub-fields, and the selective erase sub-fields SF7 to SF12 are subject to a linear coding such that an erasing data (x) is mapped on the less significant sub-fields sequentially for each gray level. Herein, the erasing data (x) is mapped only on one sub-field for determining a gray scale value. Each of the selective erase sub-fields SF7 to SF12 is going to turn off the cells unnecessary for the previous sub-fields.

In the address period of the selective erase sub-fields SF7 to SF12, an erase data pulse having a pulse width of approximately 1 μs is generated from the data drive IC in response to the erasing data (x). The erasing data pulse causes an erasure discharge within the cell to erase charged particles, such as wall charges and space charges, within the cell. The cell to which the erase data pulse has been applied in this manner does not generate a sustain discharge even though a sustain pulse is applied in the sustain period, and also does not generate a discharge at the next sub-field.

The PDP driving method according to the first embodiment of the present invention applies a data mapping method as described in the above Table 1 in the sub-pixel switching pattern to reduce a switching frequency of the data drive IC. In the PDP driving method according to the first embodiment of the present invention, a switching frequency of the data drive IC generated in one frame interval is equal to (the number of selective writing pulses SF1 to SF6)×(the number of scan lines). For example, in the case where the scan line of the PDP 90 is 480 lines, a switching frequency in the sub-pixel switching pattern is 6×480 lines=2880 times. This is because, when gray scale values '0' and '255' in Table 2 are compared with each other, a data mapped on each sub-field by a binary coding at the selective write sub-fields SF1 to SF6 has a different logic value while a data mapped on each sub-field at the selective erase sub-fields SF7 to SF12 has the same logic value. Accordingly, when a sub-pixel switching pattern is displayed, a switching frequency of the data drive IC in the present embodiment is reduced to ½ in comparison to the SWSE method in the Table 2 and hence a power wasted in the address period is reduced to ½ as can be seen from the equations (1) and (2).

In the PDP driving method according to the first embodiment of the present invention, when a data pattern that may be generally generated in the moving picture/still picture is displayed, an average switching frequency per electrode line occurring at one frame is merely 3×480 lines+{(0+1+1+1+1+1+1+1)/8}×480 lines=1800 times. Herein, '3×480' is a switching frequency per line of the selective write sub-fields SF1 to SF6 obtained by dividing total switching frequency generated between a gray level range '0~31' and other gray level range by the number of gray level ranges. Further, '{ }' represents a switching frequency per one line of the selective erase sub-fields SF6 to SF12 obtained by dividing total switching frequency occurring between a gray level range '0~31' and other gray level range by the number of gray level ranges. Accordingly, in the case of displaying a general data pattern, an average power consumption occurring in the address period is reduced to ⅓ in comparison to the prior art because the present switching frequency is reduced to ⅓ times of a conventional switching frequency.

Another embodiments of a code table in which a data is mapped by the sub-field mapping unit 84 is described in the following tables:

TABLE 3

| Gray Level | SF1 (1) | SF2 (2) | SF3 (4) | SF4 (8) | SF5 (16) | SF6 (32) | SF7 (64) | SF8 (128) |
|---|---|---|---|---|---|---|---|---|
| 0 | X | X | 0 | 0 | 0 | 0 | 0 | 0 |
| 1 | 0 | X | X | 0 | 0 | 0 | 0 | 0 |
| 3 | 0 | 0 | X | X | 0 | 0 | 0 | 0 |
| 7 | 0 | 0 | 0 | X | X | 0 | 0 | 0 |
| 15 | 0 | 0 | 0 | 0 | X | X | 0 | 0 |
| 31 | 0 | 0 | 0 | 0 | 0 | X | X | 0 |
| 63 | 0 | 0 | 0 | 0 | 0 | 0 | X | X |
| 127 | 0 | 0 | 0 | 0 | 0 | 0 | 0 | X |
| 255 | 0 | 0 | 0 | 0 | 0 | 0 | 0 | 0 |

TABLE 4

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0~31 | | Binary Coding | | | | X | X | 0 | 0 | 0 | 0 | 0 |
| 32~63 | | Binary Coding | | | | 0 | X | X | 0 | 0 | 0 | 0 |
| 64~95 | | Binary Coding | | | | 0 | 0 | X | X | 0 | 0 | 0 |
| 96~127 | | Binary Coding | | | | 0 | 0 | 0 | X | X | 0 | 0 |
| 128~159 | | Binary Coding | | | | 0 | 0 | 0 | 0 | X | X | 0 |
| 160~191 | | Binary Coding | | | | 0 | 0 | 0 | 0 | 0 | X | X |
| 192~223 | | Binary Coding | | | | 0 | 0 | 0 | 0 | 0 | 0 | X |
| 224~255 | | Binary Coding | | | | 0 | 0 | 0 | 0 | 0 | 0 | 0 |

As can be seen from the above tables, the PDP driving method according to the present invention expresses a gray level while turning off the unnecessary cells in the cells turned on in the previous sub-field, and a low logic of erase data (x) for turning off the selected cell is mapped on a sub-field for determining a gray scale value and the next sub-field. If the erase data (x) is mapped on two successive sub-fields in this manner, then a switching frequency is enlarged, and hence a power consumption becomes larger in comparison to the driving method according to the first embodiment of the present invention, but becomes smaller in comparison to the conventional PDP driving method or the SWSE system.

As described above, according to the present invention, in a driving system of expressing a gray scale while turning off the cells having been turned on at the previous sub-field, an erase data is mapped only on any one of sub-field or a predetermined number of sub-fields and a writing data for sustaining the cells having been turned on at the sub-fields following the sub-field at which the erase data has been mapped is mapped. As a result, according to the present invention, a switching frequency resulting from a difference of gray scale value is reduced, so that it becomes possible to reduce a power consumption required for the addressing operation. Furthermore, a driving IC driven with a high voltage can be replaced by a drive IC driven with a low voltage and an energy recovery circuit can be omitted, so that it becomes possible to reduce a cost of the drive IC and the PDP device.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A selective write and selective erase driving method for a frame of a plasma display panel, comprising the steps of:

providing at least one write sub-field in the frame for writing data for selecting on-cells;

providing at least one erase sub-field in the frame for expressing a gray scale value;

mapping an erase data having a first logic value for selecting an off-cell onto a number of erase sub-fields in the frame smaller than a total number of erase sub-fields in the frame; and mapping a data having a second logic value different from the first logic value of said erase data onto remaining erase sub-fields in the frame other than the erase sub-field on which said erase data has been mapped.

2. The method as claimed in claim 1, wherein said erase data is mapped on a single erase sub-field for detennining a gray scale value.

3. The method as claimed in claim 1, wherein said erase data is mapped on a single erase sub-field for determining a gray scale value and a predetermined number of sub-fields in the frame following the erase sub-field.

4. The method as claimed in claim 1, wherein said erase data is linearly mapped on said erase sub-fields.

5. The method as claimed in claim 1, wherein said data having the second logic value is said writing data.

6. The method of claim 1, wherein the erase data is mapped onto only a single erase sub-field in the frame.

7. The method of claim 1, wherein the erase data is mapped onto only two erase sub-fields in the frame.

8. A method of driving a plasma display panel, comprising the steps of:

providing at least one of a plurality of write sub-fields in a frame for on-cell selection;

providing at least one of a plurality of erase sub-fields in the frame for addressing off-cells;

mapping a first data for selecting said off-cells onto a number of erase sub-fields in the frame smaller than a total number of erase sub-fields in the frame; and mapping a second data having a logic value different from a logic value of said first data onto remaining erase sub-fields in the frame other than the erase sub-field on which said first data has been mapped. wherein the method is a selective write and a selective erase driving method for the frame.

9. The method as claimed in claim 8, wherein said first data is mapped on a single erase sub-field for determining a gray scale value.

10. The method as claimed in claim 8, wherein said first data is mapped on a single erase sub-field for determining a gray scale value and a predetermined number of sub-fields in the frame following the erase sub-field.

11. The method as claimed in claim 8, wherein said first data is linearly mapped on said erase sub-fields.

12. The method as claimed in claim 8, wherein said second data has a logical value for selecting an on-cell.

13. The method of claim 8, wherein the first data is mapped onto only a single erase sub-field in the frame.

14. The method of claim 8, wherein the first data is mapped Onto only two erase sub-fields in the frame.

15. A selective write and selective erase driving apparatus for a frame in a plasma display panel, comprising:

a plurality of address electrodes supplied with an erase data in the frame for selecting an off-cell and a writing data in the frame for selecting an on-cell;

a sub-field mapping unit for mapping said writing data onto a number of write sub-fields in the frame, the sub-field mapping unit also for mapping said erase data onto a number of erase sub-fields smaller than a total number of erase sub-fields in the frame selecting said off-cell in response to said erase data and for mapping a data having a logic value different from a logic value of said erase data onto remaining erase sub-fields in the frame other than the erase sub-field on which said erase data has been mapped; and a data driver for applying a video data to the address electrodes in response to said erase data, said writing data and data having the logic value different from the logic value of said erase data.

16. The driving apparatus as claimed in claim 15, wherein said sub-field mapping unit maps said erase data onto a single erase sub-field for determining a gray scale value.

17. The driving apparatus as claimed in claim 15, wherein said sub-field mapping unit maps said erase data Onto a single erase sub-field for determining a gray scale value and a predetermined number of sub-fields in the frame following the single erase sub-field.

18. The driving apparatus as claimed in claim 15, wherein said sub-field mapping unit linearly maps said erase data onto said erase sub-fields.

19. The driving apparatus as claimed in claim 15, wherein said sub-field mapping unit maps said writing data onto at least one of the write sub-fields in the frame for selecting on-cells using a binary coding.

20. The driving apparatus as claimed in claim 15, wherein said data .having the logic value different from the logic value of said erase data is said writing data.

21. The driving apparatus as claimed in claim 15, further comprising:

a plurality of scan electrodes traversing said address electrodes;

a scan driver supplying a scan pulse to said scan electrodes and supplying a sustain pulse for sustaining a discharge of the on-cell;

a plurality of sustain electrodes traversing said address electrodes and pairing with said scan electrodes; and a sustain driver for supplying said sustain pulse, which operates alternatively with said scan driver, said sustain driver supplying said sustain pulse in the frame.

22. The driving apparatus as claimed in claim 15, wherein said sub-field mapping unit maps said writing data on at least one of the write sub-fields in the frame so that said on-cell is selected.

23. The driving apparatus as claimed in claim 22, wherein said sub-field mapping unit maps said writing data on said write sub-field using a binary coding.

24. The driving apparatus as claimed in claim 23, wherein said sub-field mapping unit maps said erase data while selecting said off-cell among said on-cells selected in the previous sub-fields in the frame including said write sub-fields.

25. The driving apparatus of claim 15, wherein the erase data is mapped onto only a single erase sub-field in the frame.

26. The driving apparatus of claim 15, wherein the erase data is mapped onto only two erase sub-fields in the frame.

27. A plasma display apparatus comprising:

a plasma display panel having address electrodes, sustain electrodes and scan electrodes;

a driver apparatus to drive signals in a frame on the address electrodes, the sustain electrodes and the scan electrodes using selective write and selective erase driving techniques for the frame; and a mapping unit coupled to the driver apparatus to map data to be applied to the plasma display panel, the mapping unit to map write data onto a number of write sub-fields in t the frame, and the mapping unit to map erase data onto a number of erase sub-fields in the frame less than a total number of erase sub-fields in the frame, the mapping unit to map data having a logic value different than a logic value of the erase data to remaining erase sub-fields in the frame.

28. The plasma display apparatus as claimed in claim 27, wherein said mapping unit maps said erase data onto a single erase sub-field for determining a gray scale value.

29. The plasma display apparatus as claimed in claim 27, wherein said mapping unit maps said erase data onto a single erase sub-field for determining a gray scale value and a predetermined number of sub-fields in the frame following the single erase sub-field.

30. The plasma display apparatus as claimed in claim 27, wherein said mapping unit linearly maps said erase data Onto said erase sub-fields.

31. The plasma display apparatus as claimed in claim 27, wherein said mapping unit maps writing data onto at least one write sub-field in the frame for selecting on-cells using a binary coding.

32. The plasma display apparatus as claimed in claim 27, wherein said data having the logic value different from the logic value of said erase data is writing data.

33. The plasma display apparatus as claimed in claim 27, wherein:

the scan electrodes traverse said address electrodes, the sustain electrodes traverse said address electrodes and pair with said scan electrodes, and the driver apparatus includes a scan driver and a sustain driver, the scan driver supplying a scan pulse to said scan electrodes in the frame and supplying a sustain pulse in the frame for sustaining a discharge of on-cells, and the sustain driver supplying said sustain pulse, which operates alternatively with said scan driver, the sustain driver supplying said sustain pulse in the frame.

34. The plasma display apparatus as claimed in claim 27, wherein said mapping unit maps writing data on write sub-fields using a binary coding.

35. The plasma display apparatus as claimed in claim 34, wherein said mapping unit maps said erase data while selecting an off-cell among said on-cells selected in the previous sub-fields in the frame including said write sub-fields.

36. The plasma display apparatus as claimed in claim 27, wherein said mapping unit maps writing data on at least one write sub-field in the frame so that an on-cell is selected.

* * * * *